US011423807B2

(12) United States Patent
Marrs

(10) Patent No.: US 11,423,807 B2
(45) Date of Patent: Aug. 23, 2022

(54) UNIVERSAL BRANDING PANEL

(71) Applicant: VCE IP Holding Company LLC, Richardson, TX (US)

(72) Inventor: Samuel Maxwell Marrs, Bradley, IL (US)

(73) Assignee: EMC IP HOLDING COMPANY LLC, Round Rock, TX (US)

( * ) Notice: Subject to any disclaimer, the term of this patent is extended or adjusted under 35 U.S.C. 154(b) by 84 days.

(21) Appl. No.: 16/778,419

(22) Filed: Jan. 31, 2020

(65) Prior Publication Data

US 2020/0168128 A1 May 28, 2020

Related U.S. Application Data

(63) Continuation of application No. 15/393,930, filed on Dec. 29, 2016, now Pat. No. 10,586,471.

(51) Int. Cl.

| | |
|---|---|
| ***G09F 3/02*** | (2006.01) |
| ***G09F 13/22*** | (2006.01) |
| ***G09F 3/04*** | (2006.01) |

(52) U.S. Cl.

CPC ..... *G09F 3/02* (2013.01); *G09F 3/04* (2013.01); *G09F 13/22* (2013.01); *G09F 2013/222* (2013.01)

(58) Field of Classification Search

CPC ... G09F 3/02; G09F 13/22; G09F 3/04; G09F 2013/222; G09F 7/06; G06F 1/1601; G06F 1/1613; H05K 5/017; H05K 5/0252; H05K 5/1498; H05K 7/14; H05K 7/1405

See application file for complete search history.

(56) References Cited

U.S. PATENT DOCUMENTS

| | | | | |
|---|---|---|---|---|
| 2,245,885 A | | 6/1941 | Webster | |
| 2,881,306 A | | 4/1959 | Sherron | |
| 2,934,590 A | * | 4/1960 | Thompson | H02B 1/048 174/53 |
| 4,063,660 A | * | 12/1977 | Ware | H02G 3/123 220/3.6 |
| 4,848,017 A | | 7/1989 | Bailey et al. | |
| 5,450,221 A | * | 9/1995 | Owen | B60Q 3/14 362/23.18 |
| 5,515,237 A | * | 5/1996 | Ogami | H05K 5/0295 361/740 |

(Continued)

OTHER PUBLICATIONS

Notice of Allowance and Fee(s) Due for U.S. Appl. No. 15/393,930 (dated Dec. 10, 2019).

(Continued)

*Primary Examiner* — Cassandra Davis

(74) *Attorney, Agent, or Firm* — Jenkins, Wilson, Taylor & Hunt, P.A.

(57) ABSTRACT

A branding device includes a housing, a faceplate, a backlit recess within the housing, housing retention features, and faceplate retention features. The branding device is configured to be installed within a corresponding recess of a panel, such that the faceplate can be removed and replaced without requiring replacement of the entire branding device. To update the branding information of the branding device, the faceplate retention features must be disengaged from the rear of the branding device, the faceplate is then removed, and a faceplate with updated branding information is then installed.

20 Claims, 8 Drawing Sheets

(56) References Cited

U.S. PATENT DOCUMENTS 5,715,136 A * 2/1998 Noe ..... G06F 1/16 361/679.21
5,778,479 A * 7/1998 Raia ..... A46B 5/02 15/176.2
5,778,579 A * 7/1998 Yuen ..... G09F 13/08 40/564
5,783,777 A * 7/1998 Kruse ..... H05K 7/1461 174/66
6,570,770 B1 * 5/2003 Ross ..... H05K 5/023 174/51
6,686,540 B2 * 2/2004 Compagnone, Jr. ..... H02G 3/12 174/58
7,255,466 B2 * 8/2007 Schmidt ..... H03K 17/9622 362/85
7,338,140 B1 * 3/2008 Huang ..... G06F 1/181 312/223.2
7,424,785 B2 * 9/2008 Feroli ..... G09F 3/18 361/679.55
8,077,452 B2 * 12/2011 Wang ..... G06F 1/181 361/679.6
9,215,824 B2 * 12/2015 Sun ..... H05K 7/00
9,655,268 B2 * 5/2017 Wang ..... H03K 17/964
10,401,081 B2 * 9/2019 Jorapur ..... A47F 3/0426
10,586,471 B1 3/2020 Marrs
11,019,746 B1 * 5/2021 Balekundri ..... F24C 3/12
2003/0163940 A1 * 9/2003 Mautz ..... G09F 3/204 40/661.11
2013/0180139 A1 * 7/2013 Underwood ..... H02G 3/14 40/543

OTHER PUBLICATIONS

Advisory Action for U.S. Appl. No. 15/393,930 (dated Oct. 25, 2019).
Final Office Action for U.S. Appl. No. 15/393,930 (dated Aug. 16, 2019).
Non-Final Office Action for U.S. Appl. No. 15/393,930 (dated Feb. 26, 2019).
Advisory Action for U.S. Appl. No. 15/393,930 (dated Dec. 12, 2018).
Final Office Action for U.S. Appl. No. 15/393,930 (dated Oct. 4, 2018).
Non-Final Office Action for U.S. Appl. No. 15/393,930 (dated Jul. 27, 2018).
Commonly-Assigned, co-pending U.S. Appl. No. 15/393,930 for "Universal Branding Panel," (Unpublished, filed Dec. 29, 2016).

* cited by examiner

UNIVERSAL BRANDING PANEL

PRIORITY CLAIM

This application is a continuation of U.S. patent application Ser. No. 15/393,930 filed Dec. 29, 2016, the disclosure of which is incorporated herein by reference in its entirety.

TECHNICAL FIELD

The subject matter described herein relates to product identification features. More specifically, the subject matter relates to devices, systems, and methods for a universal product identifier panel for computing and computing infrastructure products.

BACKGROUND

Today's product marketing solutions are focused on branding of products and how fast the product branding requirements can change, along with accommodating aspects of certain "flavor of the week" branding design concepts that have recently come to dominate the product marketing identification world. The demands of this fast-paced churn of product branding creates a significant hurdle, requiring significant design resources and capital investment to produce product branding concepts of the type required to maintain a foot hold in the market. The current solution to this dilemma is to have every unique branding style built and installed on a given product for identification in marketplace. Accordingly, every new version must be assembled and inventoried, ready at a moment's notice to be assembled to the next product. Costly branding badges/plates are built for every version, type, and color to match for a set of products. Whenever the branding design changes for a given product set, it is vital for continued customer recognition in the marketplace for the updated design to be applied, not only on newly shipped products but also on existing products out in the marketplace. To this end, all of the possible iterations are built, shipped to a remote location, and must be attached at the remote location.

Where the branding being updated is for a product having a very long service life (e.g., a computer infrastructure, or server, cabinet), it is particularly undesirable for previous branding designs to remain in installations without being replaced. Since products such as server cabinets may be in place for multiple generations of server equipment installations, it is undesirable to leave old branding on server cabinets where the old branding may be different from the branding on any newly installed computing infrastructure equipment (e.g., servers) as well as different from server cabinets which are installed at later dates. It is of particular importance, often the server cabinets have perforated doors installed on the front and rear for security reasons; as such, the branding of the individual computing infrastructure equipment installed inside the rack is not visible. Therefore, if the server cabinet branding is updated to be uniform between server cabinets of different ages, then the message sought to be conveyed by the updated branding will be, at best, muddled and unclear, thereby not delivering the proper impact of such branding update decisions.

Where a computer infrastructure product, such as a server cabinet, requires updated branding, some degree of installation of the updated branding onto the door or cabinet is required (see, e.g., FIG. 1). For computing infrastructure products, a conventional branding panel may include an external printed color faceplate, an illuminated background, a wiring harness connected to a power source within the computing infrastructure product, and corresponding cutouts in each panel of the computing infrastructure product for the specific product branding and printed color plate design being attached. The conventional panel is installed by passing the wiring harness through the cutout in the pertinent panel and connecting it to a power source within the computing infrastructure product. The panel is mounted to the cabinet door using fasteners. As such, the rapidly changing product branding demands and the financial and logistical costs of proliferating such rebranded product branding concepts throughout the marketplace

SUMMARY

In one aspect, a branding device (e.g., a universal branding panel) is provided. The branding device includes a housing and a faceplate. The housing includes one or more housing retention features configured to affix the housing within a recess of a computing infrastructure device and one or more housing-faceplate interface features. The faceplate includes one or more faceplate retention features on a first side of the faceplate, and a decorative pattern visible from a second side of the faceplate. The faceplate retention features are configured to secure the faceplate to an external face of the housing. The branding device is configured to be updated by removing the faceplate from the housing and installing a replacement faceplate onto the housing.

In another aspect, a method of branding a computing infrastructure device is provided. The method includes installing a housing at least partially within a recess of the computing infrastructure device, securing the housing to the computing infrastructure device by one or more housing retention features, installing a faceplate one the housing; and securing the faceplate to the housing by engaging one or more faceplate retention features on a first side of the faceplate with one or more housing-faceplate retention features, the faceplate comprising a decorative pattern visible from a second side of the faceplate According to still another aspect, a method of updating the branding of a computing infrastructure device is provided, the method including accessing a rear portion of a branding device, disengaging one or more interlocking faceplate retention features from corresponding housing retention features, removing a faceplate from a housing affixed to the computing infrastructure device, and installing another faceplate onto the housing.

BRIEF DESCRIPTION OF THE DRAWINGS

The subject matter described herein will now be explained with reference to the accompanying drawings of which.

DETAILED DESCRIPTION

The subject matter described herein discloses systems and devices for an improved product branding panel as well as improved methods of installing such improved branding panels. An improved branding device (e.g., a universal branding panel) is disclosed herein. The branding device is configured to be installed in new and existing devices regardless of the shape of the new product identification branding. The branding device may have a unitary design for easy installation into a compatible feature (e.g., a recess) on a product (e.g., a server cabinet door). The branding device is further configured to lock in place within the compatible feature. Where the branding device requires power to function, a harness may be connected to a power source within the product to which the branding device is attached. The branding device may be an assembly including two major parts, a housing and a front-facing faceplate (e.g., a printed branding panel). Once the branding device assembly is installed in the compatible feature of the product, the faceplate can be configured to be removed without requiring removal of the housing. As such, an outdated faceplate can be removed and an updated faceplate of the type currently being distributed can be installed.

Figures (also "FIGS.") 1 through 6 illustrate various views, aspects, and/or features associated with universal branding panels and methods of installation thereof.

Figure 1:
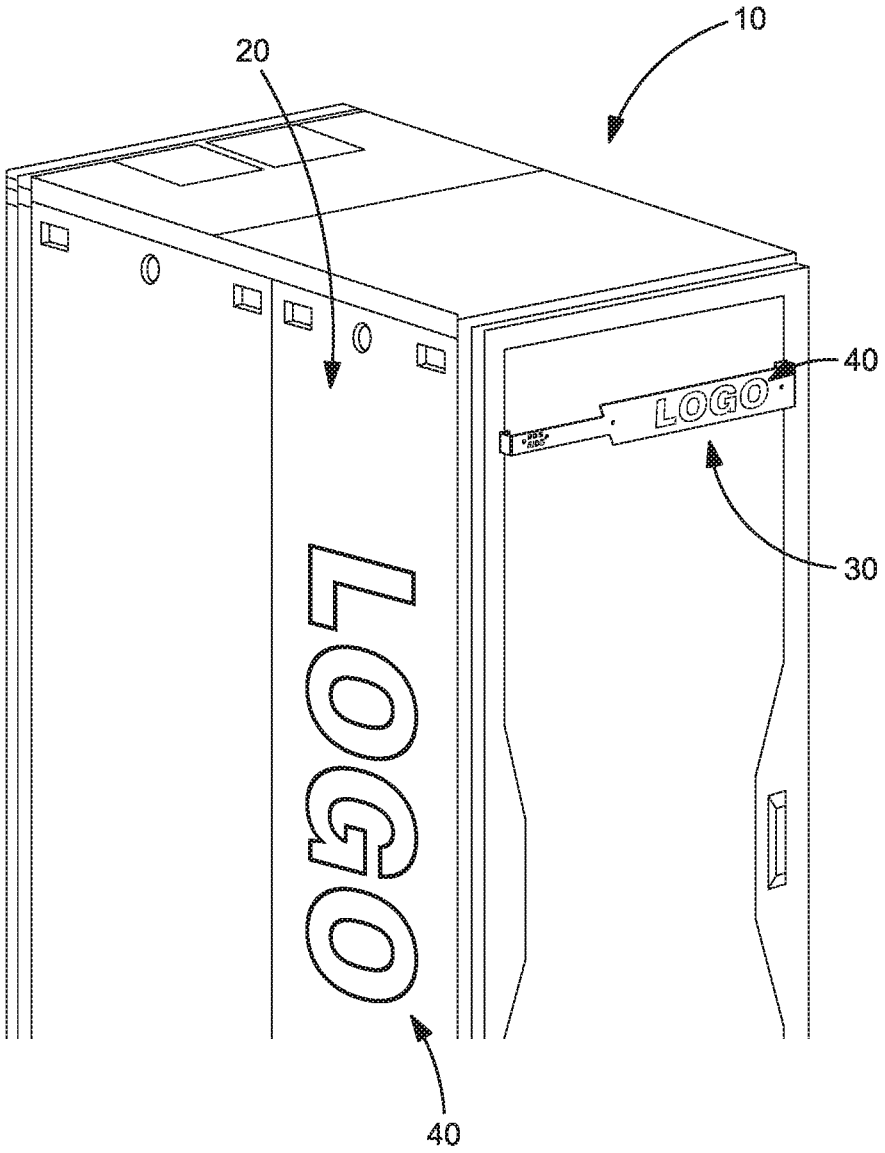
FIG. 1 is a perspective view of a computing infrastructure device with a conventional branding panel installed thereon.
Figure 2:
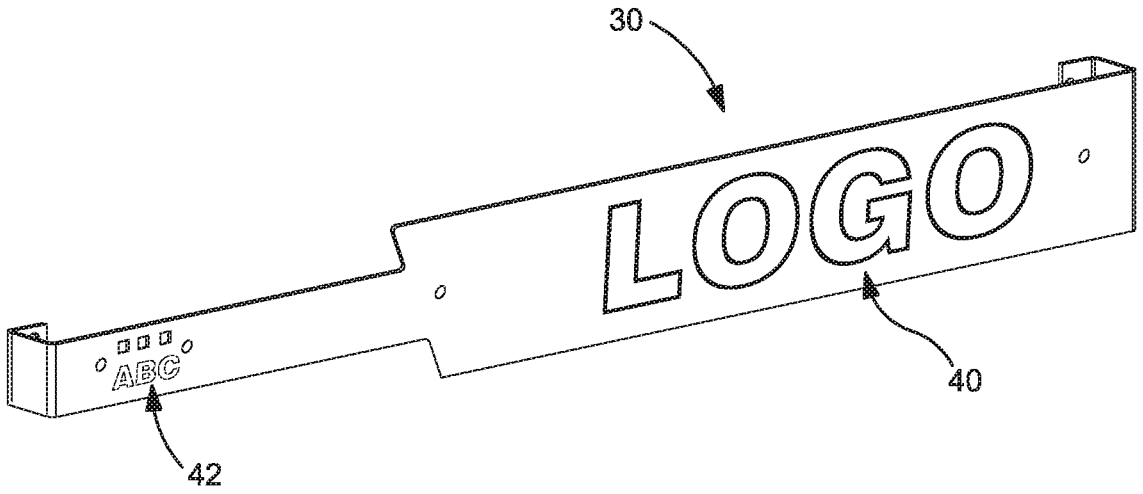
FIG. 2 is an isolated, perspective view of the conventional branding panel illustrated in FIG. 1.

Referring to FIGS. 1 and 2, an example front branding panel, generally designated 30, according to a conventional design suitable for installation on a cabinet, generally designated 10, is illustrated. Cabinet 10 has, as can be seen in FIG. 1, both a side branding panel, generally designated 20, and front branding panel 30. Front branding panel 30 is manufactured and must be installed onto cabinet 10. As can be seen, front branding panel 30 is affixed externally onto or through an outer surface (e.g., a lockable door) of cabinet 10. As such, the attachment structures (e.g., screws) of front branding panel 30 remain accessible to those who may not otherwise have access to the interior of cabinet 10 and, therefore, front branding panel 30 is not tamper-proof. Front branding panel 30 includes a lighted background portion, a harness to connect to cabinet 10 for power, and cutouts in each panel for the specific product branding and printed color plate. Front branding panel 30 can, for example, be installed by passing the harness through the outer surface of cabinet 10 and connected to a power source of cabinet 10. As will be appreciated, the need to replace the entire assembly of front branding panel is costly and requires significant capital investments to design, ship, and install updated branding panels.

Referring to FIGS. 3-6, an example lockable front door and an example embodiment for the branding device are illustrated therein.

Figure 3:
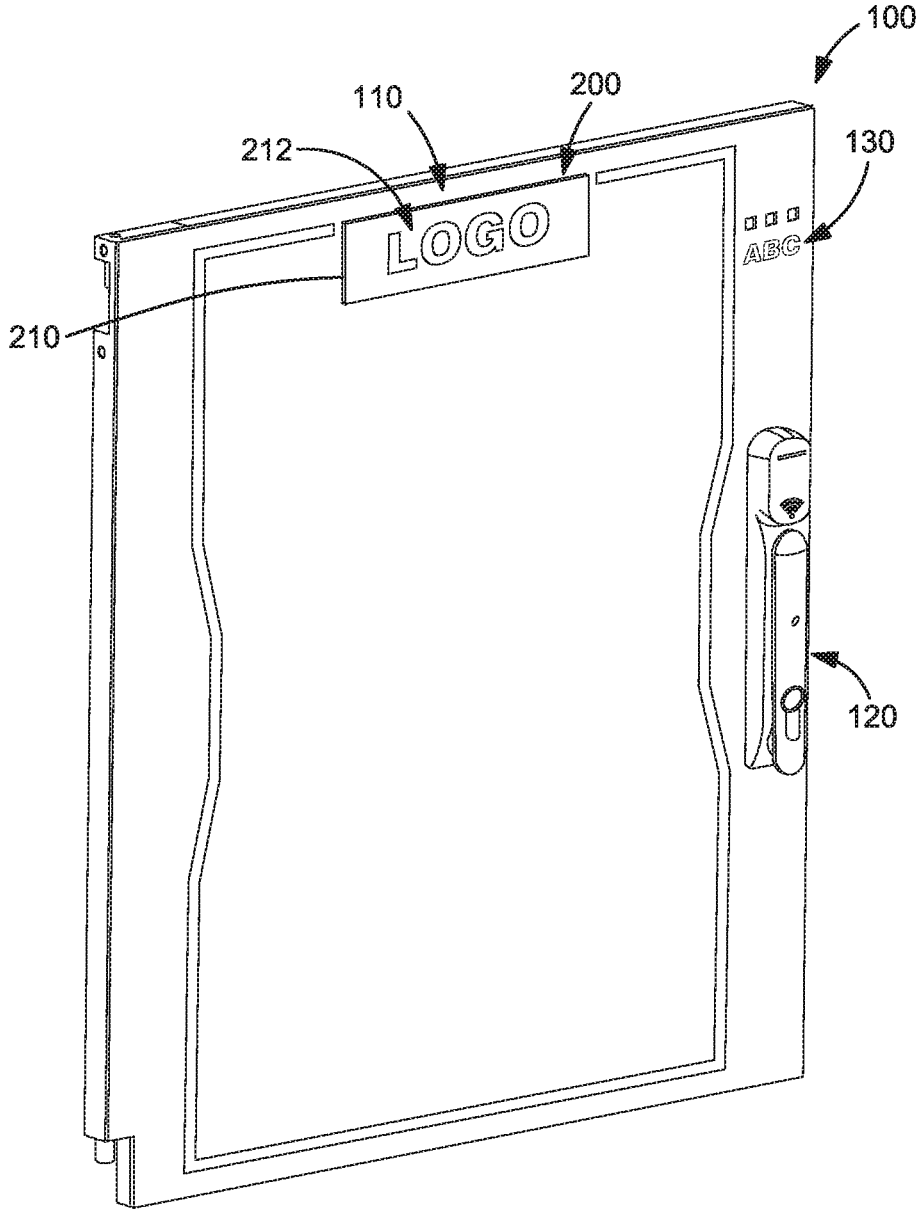
FIG. 3 is a perspective view of an example door panel of a computing infrastructure device with a branding device according to one embodiment installed thereon.

FIG. 3 illustrates a door panel, generally designated 100, having a recess, generally designated 110, (e.g., a cut-out portion). Branding device, generally designated 200, is illustrated in an installed position. In the installed position, branding device 200 is disposed within, at least partially, recess 110 of door panel 100. Branding device 200 may be either flush with, recessed within, or protrudes beyond an outer surface of door panel 100. When installed, the only portion of branding device 200 externally visible is a faceplate 210 and a faceplate logo, generally designated 212, which is integral with faceplate 210. Faceplate logo 212 can include any desired decorative pattern, which can be opaque, semi-translucent, translucent, clear, or a void (e.g., the material of the faceplate is removed to create a negative image for the decorative pattern). Door panel 100 can further comprise a locking mechanism, generally designated 120, and a secondary logo, generally designated 130. While secondary logo 130 is illustrated as being integral to door panel 100, It is contemplated that secondary logo 130 can be in the form of a branding device substantially similar to, or different from, branding device 200.

Figure 4:
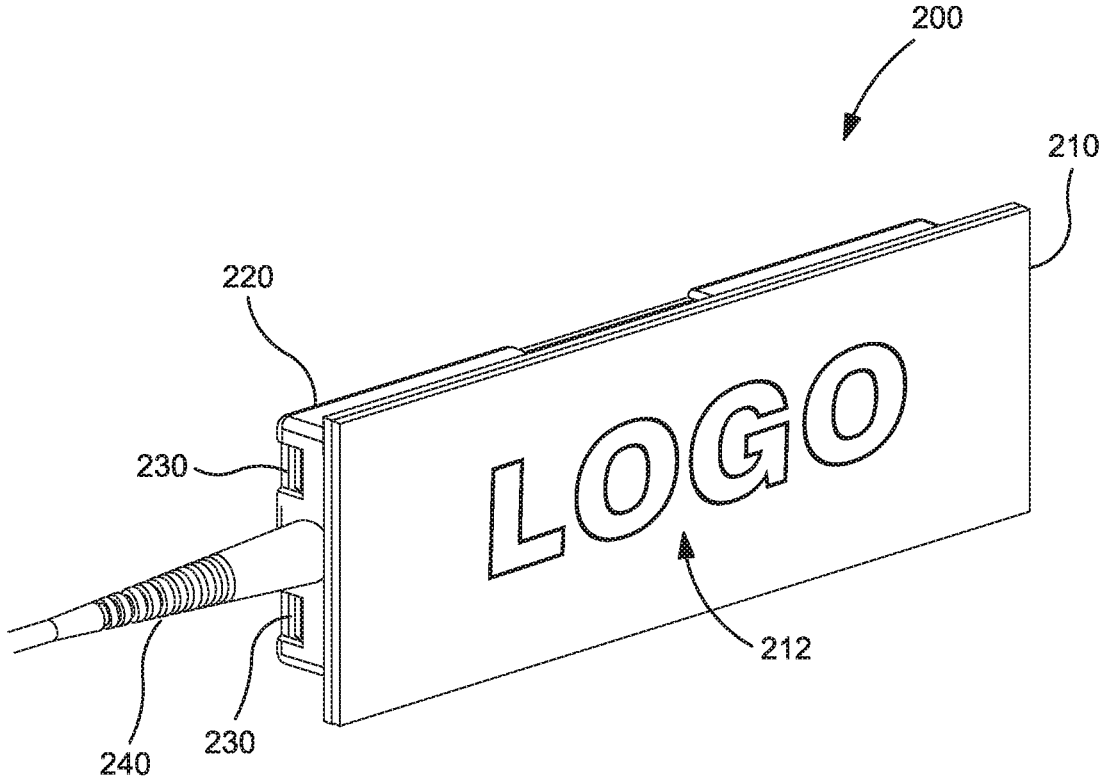
FIG. 4 is an isolated, perspective view of the branding device illustrated in FIG. 3 in an assembled state.

Referring to FIG. 4, branding device 200 according to one embodiment is illustrated in an assembled state. Faceplate logo 212 is illustrated as being integrally formed from faceplate 210 (e.g., by stamping, molding, or other suitable processes). Faceplate 210 is affixed to housing 220. Faceplate logo 212 can comprise or consist of a clear translucent material which can be tinted or clear; it is also possible for faceplate logo 212 to be a void in faceplate 210 with no material in the areas indicated. Housing 220 can comprise a backlit region, generally designated 222, (FIG. 5) with a light source 224 therein to a backlit effect, shining light through and illuminating faceplate logo 212 of faceplate 210. Harness 240 protrudes from a side of housing 220 and is in electrical communication with (e.g., plugged into) a power source 242 external from branding device 200. In some embodiments, harness 240 can be replaced with one or more electrical contacts on housing 220 which contact (e.g., in a manner of an interference fit) compatible electrical contacts within recess 110 configured to provide power to housing 220 to illuminate backlit region 222.

Figure 5:
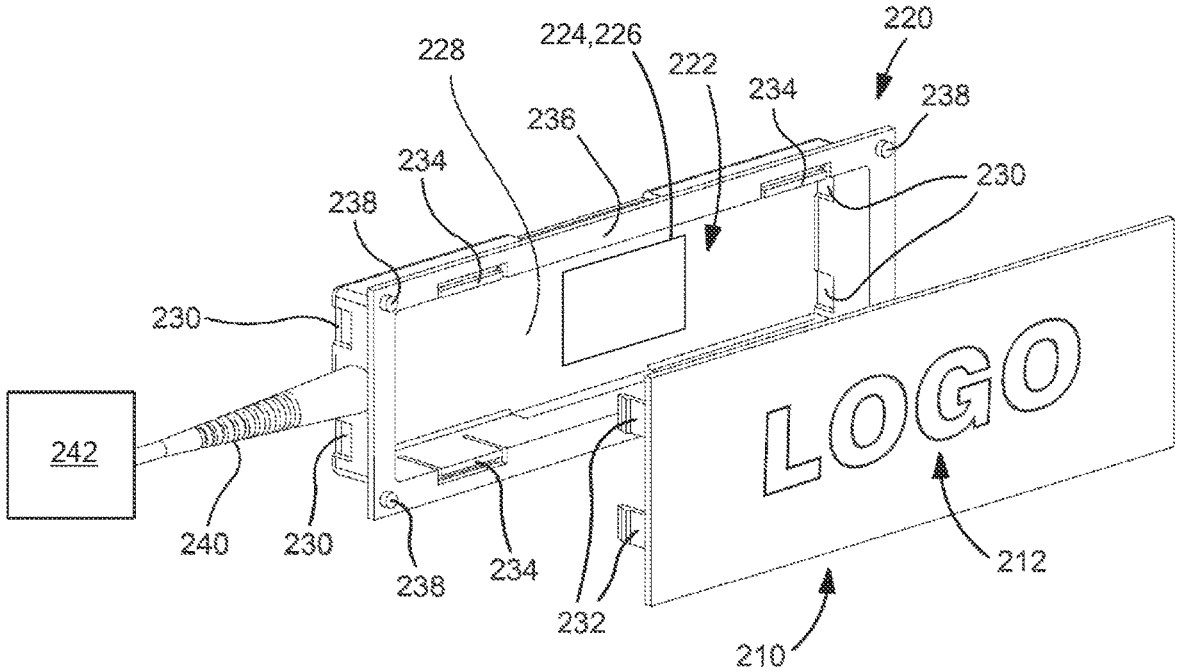
FIG. 5 is a partially exploded, perspective view of the branding device illustrated in FIG. 4 in a disassembled state.
Figure 7:
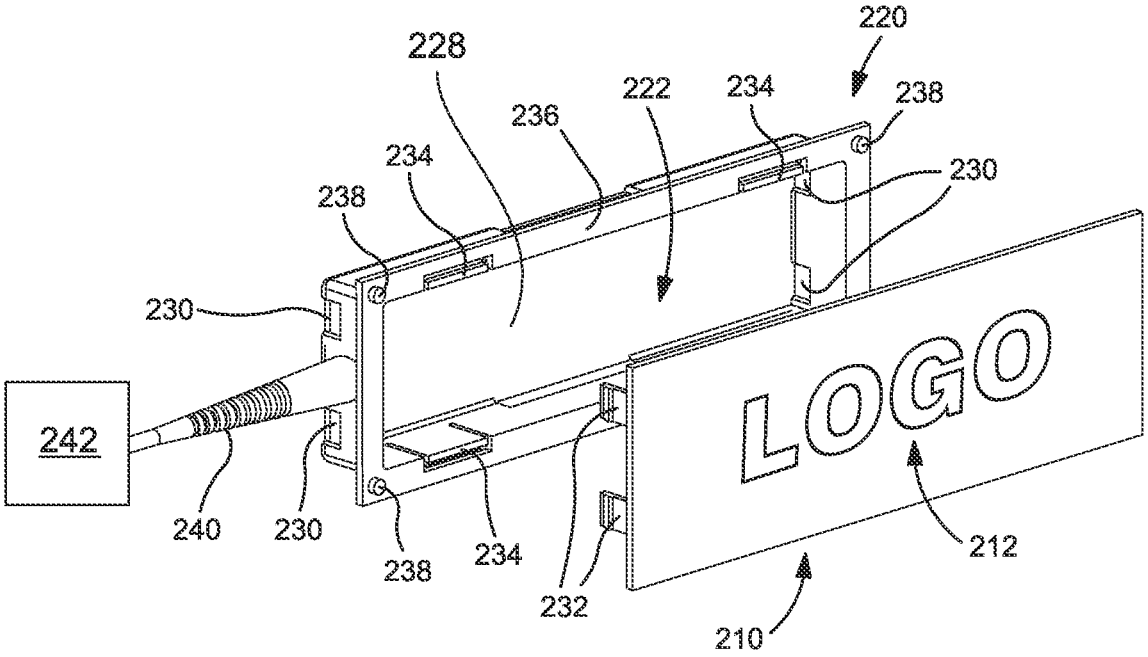
FIG. 7 is a partially exploded, perspective view another example embodiment of a branding device in a disassembled state.
Figure 8:
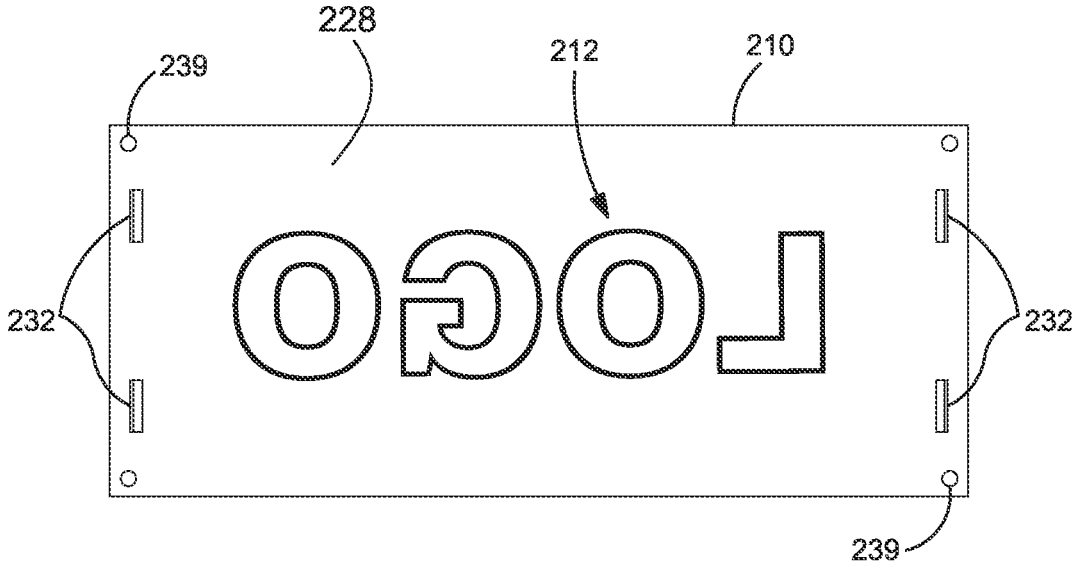
FIG. 8 is a rear view of another example embodiment of a faceplate used in a branding device.

FIG. 5 illustrates branding device 200 according to the embodiment illustrated in FIG. 4, but where branding device is in a disassembled state with faceplate 210 detached from housing 220. As described some previously, housing 220 can comprise a backlit region 222 (e.g., an internal cavity) defined by an inner surface of housing 220. In some embodiments, housing may have lighting devices (e.g., light emitting diodes, or LEDs 226) disposed on an internal surface of housing 220, thereby emitting light into backlit region 222, which then illuminates faceplate logo 212. In another example embodiment, shown in FIG. 7, a luminescent coating 228 may be applied to the internal surfaces of housing 220, with power being applied to the luminescent coating 228 to cause light to be emitted into backlit region 222. In another example embodiment, shown in FIG. 8, a luminescent coating 228 may be applied to at least a portion of faceplate 210, with power being applied thereto to cause the luminescent coating 228 to emit light. In some embodiments, the color and the intensity of the light emitted may be controlled, regardless of how the light is generated.

Still referring to FIG. 5, housing 220 has a flange 236 around at least a portion of the perimeter of the outer side thereof. Housing retention features 234 can comprise movable tabs which lockingly interface with an edge of cabinet 10 surrounding the recess to secure the edge between each movable tab and flange 236. Housing 220 can comprise housing-faceplate interface features 230 such as two that are in the form of recessed cavities formed in opposing lateral sides thereof. Faceplate 210 has a pair of opposing faceplate retention features 232 formed on and protruding from a rear face thereof. Faceplate retention features 232 are illustrated as being in the form of tabbed structures configured to interlock with a corresponding cavity of the housing-faceplate interface features 230 and disposed to be co-located with and to lockingly interface with housing-faceplate interface features 230 when branding device 200 is in an assembled state. Locating nubs 238 are disposed on the corners of the front face of flange 236, the locating nubs 238 being configured to positively locate the position of faceplate 210 relative to housing 220. When branding device 200 is in an installed position within, for example, door panel 100, faceplate retention features 232 and housing-faceplate interface features 230 are not accessible from outside door panel 100, thereby providing a tamper-proof design, which cannot be removed from door panel 100 without access to an interior thereof (e.g., access to a rear side of housing 220). Housing 220 also has housing retention features 234, which are disposed along a perimeter of housing 220 to be adjacent to an edge of recess 110 and to lockingly interface therewith when housing is in the installed position. As such, an attempt to remove faceplate 210 without disengaging faceplate retention features 232 from housing-faceplate interface features 230 will result in damage to faceplate 210 and serve as a visual indicator of tampering.

According to this embodiment, faceplate retention features 232 may be accessed and disengaged from housing-faceplate interface features 230 without housing retention features 234 from being disengaged. This allows for faceplate 210 to be separated from housing 220 without needing to remove housing 220 from door panel 100. With faceplate 210 being removable and replaceable, it is therefore no longer necessary for the branding device 200 to be replaced in its entirety when product branding is updated. A further advantage of branding device 200 is that, because housing 220 can remain installed within recess 110, the electrical connections between branding device 200 can door panel 100 do not need to be disturbed in order for product branding to be updated.

Figure 6:
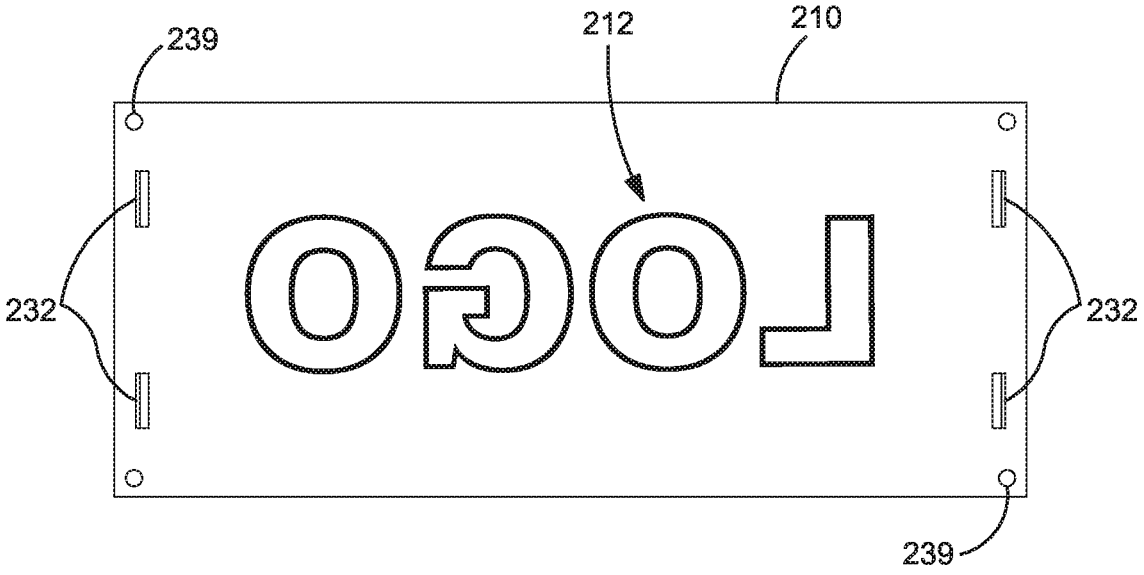
FIG. 6 is a rear view of an example embodiment of a faceplate used in a branding device.

Referring to FIG. 6, a rear surface of faceplate 210 is illustrated. The rear of faceplate 210 has a reverse image of faceplate logo 212 illustrated thereon. The rear surface of faceplate 210 can comprise locating recesses 239 formed in locations of faceplate corresponding to the positions of locating nubs 238 on housing 220, shown in FIG. 5. Faceplate retention features 232 are disposed on a rear surface of faceplate 210, located to correspond to the positions of housing retention features 234.

According to another aspect of the invention, a method of branding a computing infrastructure device is provided. The method includes installing a housing at least partially within a recess of the computing infrastructure device, securing the housing to the computing infrastructure device by one or more housing retention features, installing a faceplate one the housing; and securing the faceplate to the housing by engaging one or more faceplate retention features on a first side of the faceplate with one or more housing-faceplate retention features. In some aspects, the faceplate comprises a decorative pattern visible from a second side of the faceplate. In some other aspects, the method includes connecting a harness of the branding device to a power source of the computing infrastructure device and illuminating an interior of the housing, the decorative pattern being at least semi-translucent, and the step of illuminating the interior of the housing causing a corresponding illumination of the decorative pattern that is visible from an outside of the computing infrastructure device.

In other aspects, a method of updating the branding of a computing infrastructure device is provided, the method including accessing a rear portion of a branding device, disengaging one or more interlocking faceplate retention features from corresponding housing retention features, removing a faceplate from a housing affixed to the computing infrastructure device, and installing another faceplate onto the housing. Additionally, the steps recited above may be implemented in a method of replacing the branding information on a computing infrastructure device, including, for example, replacing the branding information due to any damage thereto during an installation procedure or otherwise occurring from typical use.

It will be obvious to persons of ordinary skill in the art that the description of the subject matter provided above is not intended to be limited to computing infrastructure devices, but includes any suitable device or structure where updating or replacing all or a portion of the branding information thereon would be advantageous.

Various combinations and sub-combinations of the structures and features described herein are contemplated and will be apparent to a skilled person having knowledge of this disclosure. Any of the various features and elements as disclosed herein can be combined with one or more other disclosed features and elements unless indicated to the contrary herein. Correspondingly, the subject matter as hereinafter claimed is intended to be broadly construed and interpreted, including all such variations, modifications and alternative embodiments, within its scope and including equivalents of the claims. It is understood that various details of the presently disclosed subject matter may be changed without departing from the scope of the presently disclosed subject matter. Furthermore, the foregoing description is for the purpose of illustration only, and not for the purpose of limitation.

What is claimed is:

1. A branding device comprising:

a housing comprising:

one or more housing retention features configured to affix the housing within a recess of a computing infrastructure device; and one or more housing-faceplate interface features;

a faceplate comprising:

a plurality of faceplate retention features formed external to the faceplate and protruding from a same side of the faceplate, each faceplate retention feature extending towards a rear of the housing when secured to the housing and being configured to secure the faceplate to an external face of the housing; and a decorative pattern visible from an opposing side of the faceplate, which is opposite the side from which the plurality of faceplate retention features protrude;

wherein the branding device is configured to be updated by removing the faceplate from the housing and installing a replacement faceplate onto the housing;

a light source oriented to emit light into an interior of the housing; and a harness in electrical communication with a power source and the light source.

2. The branding device of claim 1, wherein the plurality of faceplate retention features are arranged as pairs of opposing faceplate retention features.

3. The branding device of claim 1, wherein the light source comprises one or more light emitting diodes (LEDs) or a luminescent coating applied to at least a portion of the housing.

4. The branding device of claim 3, wherein the one or more LEDs are disposed along a perimeter of the interior of the housing.

5. The branding device of claim 1, wherein the light source is configured to emit light from the opposing side of the faceplate.

6. The branding device of claim 5, wherein the light source is a luminescent coating applied to the opposing side of the faceplate or one or more LEDs in a shape of the decorative pattern.

7. The branding device of claim 1, wherein the housing comprises a flange around at least a portion of a perimeter of a first side thereof.

8. The branding device of claim 1, wherein the one or more housing retention features comprise movable tabs configured to lockingly interface with an edge of the computing infrastructure device surrounding the recess to secure the edge between each movable tab and a flange of the housing.

9. The branding device of claim 1, wherein:

the one or more housing-faceplate interface features comprise one or more cavities formed in a side and/or rear wall of the housing; and each faceplate retention feature comprises a tabbed structure, which is configured to interlock with a corresponding cavity of the housing-faceplate interface features.

10. The branding device of claim 9, wherein the one or more faceplate retention features are only movable by accessing a rear side of the housing.

11. The branding device of claim 1, wherein the one or more housing retention features comprise movable tabs configured to lockingly engage with an edge of the computing infrastructure device surrounding the recess.

12. The branding device of claim 11, wherein:

the housing comprises a flange around at least a portion of a perimeter of the housing, at an external face thereof; and the movable tabs are configured to secure the edge of the computing infrastructure device between each of the movable tabs and the flange.

13. The branding device of claim 12, wherein the movable tabs are positioned along the perimeter of the housing, such that, when the housing is in an installed position within the recess of the computing infrastructure device, the movable tabs are adjacent to the edge of the computing infrastructure device surrounding the recess to lockingly interface therewith.

14. The branding device of claim 13, wherein the decorative pattern is integrally formed with, and coplanar to, a portion of the faceplate from which the faceplate retention features protrude.

15. A method of branding a computing infrastructure device with a branding device, the method comprising:

installing a housing at least partially within a recess of the computing infrastructure device;

securing the housing to the computing infrastructure device by one or more housing retention features;

forming a plurality of faceplate retention features that are external to a faceplate and protrude from a same side of the faceplate, each faceplate retention feature extending towards a rear of the housing when secured to the housing;

providing a light source oriented to emit light into an interior of the housing;

installing the faceplate on the housing;

connecting a harness to provide electrical communication between the light source and a power source of the computing infrastructure device; and securing the faceplate to the housing by engaging each faceplate retention feature with a corresponding housing-faceplate retention feature;

wherein the faceplate comprises a decorative pattern visible from an opposing side of the faceplate, which is opposite the side from which the plurality of faceplate retention features protrude.

16. The method of claim 15, comprising illuminating an interior of the housing;

wherein the decorative pattern is at least semi-translucent; and wherein illuminating the interior of the housing causes a corresponding illumination of the decorative pattern that is visible from an outside of the computing infrastructure device.

17. The method of claim 15, comprising updating the branding of the computing infrastructure device, wherein updating the branding comprises:

accessing a rear portion of a branding device;

disengaging one or more interlocking faceplate retention features from corresponding housing retention features;

removing a faceplate from a housing affixed to the computing infrastructure device; and installing another faceplate onto the housing.

18. The method of claim 15, wherein:

the one or more housing retention features comprise movable tabs configured to lockingly engage with an edge of the computing infrastructure device surrounding the recess;

the housing comprises a flange around at least a portion of a perimeter of the housing, at an external face thereof;

the movable tabs are configured to secure the edge of the computing infrastructure device between each of the movable tabs and the flange; and the movable tabs are positioned along the perimeter of the housing, such that, when the housing is in an installed position within the recess of the computing infrastructure device, the movable tabs are adjacent to the edge of the computing infrastructure device surrounding the recess to lockingly interface therewith.

19. The method of claim 18, wherein the decorative pattern is integrally formed with, and coplanar to, a portion of the faceplate from which the faceplate retention features protrude.

20. A branding device comprising:

a housing comprising:

one or more housing retention features configured to affix the housing within a recess of a computing infrastructure device; and one or more housing-faceplate interface features;

a faceplate comprising:

a plurality of faceplate retention features formed external to the faceplate and protruding from a same side of the faceplate, each faceplate retention feature extending towards a rear of the housing when secured to the housing and being configured to secure the faceplate to an external face of the housing; and a decorative pattern visible from an opposing side of the faceplate, which is opposite the side from which the plurality of faceplate retention features protrude;

wherein the branding device is configured to be updated by removing the faceplate from the housing and installing a replacement faceplate onto the housing; and a light source oriented to emit light into an interior of the housing;

wherein the one or more housing retention features comprise movable tabs configured to lockingly interface with an edge of the computing infrastructure device surrounding the recess to secure the edge between each movable tab and a flange of the housing; or wherein:

the one or more housing-faceplate interface features comprise one or more cavities formed in a side and/or rear wall of the housing; and each faceplate retention feature comprises a tabbed structure, which is configured to interlock with a corresponding cavity of the housing-faceplate interface features; or wherein the one or more housing retention features comprise movable tabs configured to lockingly engage with an edge of the computing infrastructure device surrounding the recess.

* * * * *